US007668332B2

(12) United States Patent
Williams et al.

(10) Patent No.: US 7,668,332 B2
(45) Date of Patent: Feb. 23, 2010

(54) AUDIO PORTING ASSEMBLY

(75) Inventors: William R. Williams, Coral Springs, FL (US); Deborah A. Gruenhagen, Southwest Ranches, FL (US); Scot A. Hendry, Elgin, IL (US); Richard L. Willis, Lauderhill, FL (US)

(73) Assignee: Motorola, Inc., Schaumburg, IL (US)

( * ) Notice: Subject to any disclaimer, the term of this patent is extended or adjusted under 35 U.S.C. 154(b) by 932 days.

(21) Appl. No.: 11/255,568

(22) Filed: Oct. 21, 2005

(65) Prior Publication Data

US 2007/0092097 A1 Apr. 26, 2007

(51) Int. Cl.
*H04R 1/02* (2006.01)

(52) U.S. Cl. ..... 381/386; 381/360

(58) Field of Classification Search ..... 381/337, 381/345, 349, 350, 351, 352, 353, 354, 355, 381/359, 360, 361, 368
See application file for complete search history.

(56) References Cited

U.S. PATENT DOCUMENTS

| | | | | |
|---|---|---|---|---|
| 4,550,429 | A | 10/1985 | Burbank et al. | |
| 5,241,695 | A | 8/1993 | Roshitsh et al. | |
| 6,038,328 | A * | 3/2000 | Hsu | 381/361 |
| 6,091,830 | A * | 7/2000 | Toki | 381/359 |
| 2007/0113964 | A1 * | 5/2007 | Crawford et al. | 156/249 |

* cited by examiner

*Primary Examiner*—Walter F Briney, III
(74) *Attorney, Agent, or Firm*—Barbara R. Doutre

(57) ABSTRACT

Both water intrusion and wind noise issues are addressed with an audio porting assembly including a single frame (102) having a speaker cavity (110) and a microphone cavity (112) formed therein. An opening (114) formed within the frame (102) between the speaker cavity (110) and the microphone cavity (112) provides a path for indirect porting from the speaker cavity into the microphone cavity. A unitarily molded membrane (104) provides a seal over the frame (102).

20 Claims, 6 Drawing Sheets

AUDIO PORTING ASSEMBLY

TECHNICAL FIELD

This invention relates in general to communication devices and more particularly to audio porting in communication devices.

BACKGROUND

Water and wind are two environmental conditions that can easily turn a microphone porting system that works well in dry/calm conditions into one that is totally inoperative. For a device exposed to wet conditions, the surface tension of water can cover the small holes in the housing used for audio ports thereby completely blocking the audio path. Wind passing over the microphone port can generate small pressure pulses which the microphone cartridge converts into noise, generally referred to as wind noise.

Wind noise is problematic for both portable and mobile style microphones. Portable microphone products include communication devices, such as handheld radios and their associated accessories, having a microphone integrated therein. For example, some handheld radios operate in conjunction with an accessory having an additional separate microphone, such as a remote speaker microphone worn on a user's shoulder. A mobile microphone is generally a handheld device coupled to a vehicular radio mounted on or under the dashboard. Current microphone products exist for each microphone style that address either wind noise or water blockage problems, but not both.

Wind noise solutions have typically been incorporated into mobile style microphones by moving the microphone cartridge back away from the front housing and using a large ported surface area to settle the pressure pulses. Due to space limitations, made even more difficult with the addition of a speaker, this type of solution can not be readily implemented into a portable communication device.

Water blockage solutions have typically been incorporated into portable style microphones by adding an alternate acoustic path, referred to as a sneak path, which enables audio to reach the microphone even if the primary audio path becomes blocked. Wind noise performance for this type of porting scheme, or any direct porting scheme with the microphone mounted close to the front surface of the product, is usually poor. Felt is often used in microphone porting schemes to resist rain and dust intrusion, but given enough exposure, felt has a tendency to absorb water and allow water penetration which can completely block the microphone port.

Accordingly, it would be beneficial to have an improved audio porting scheme.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
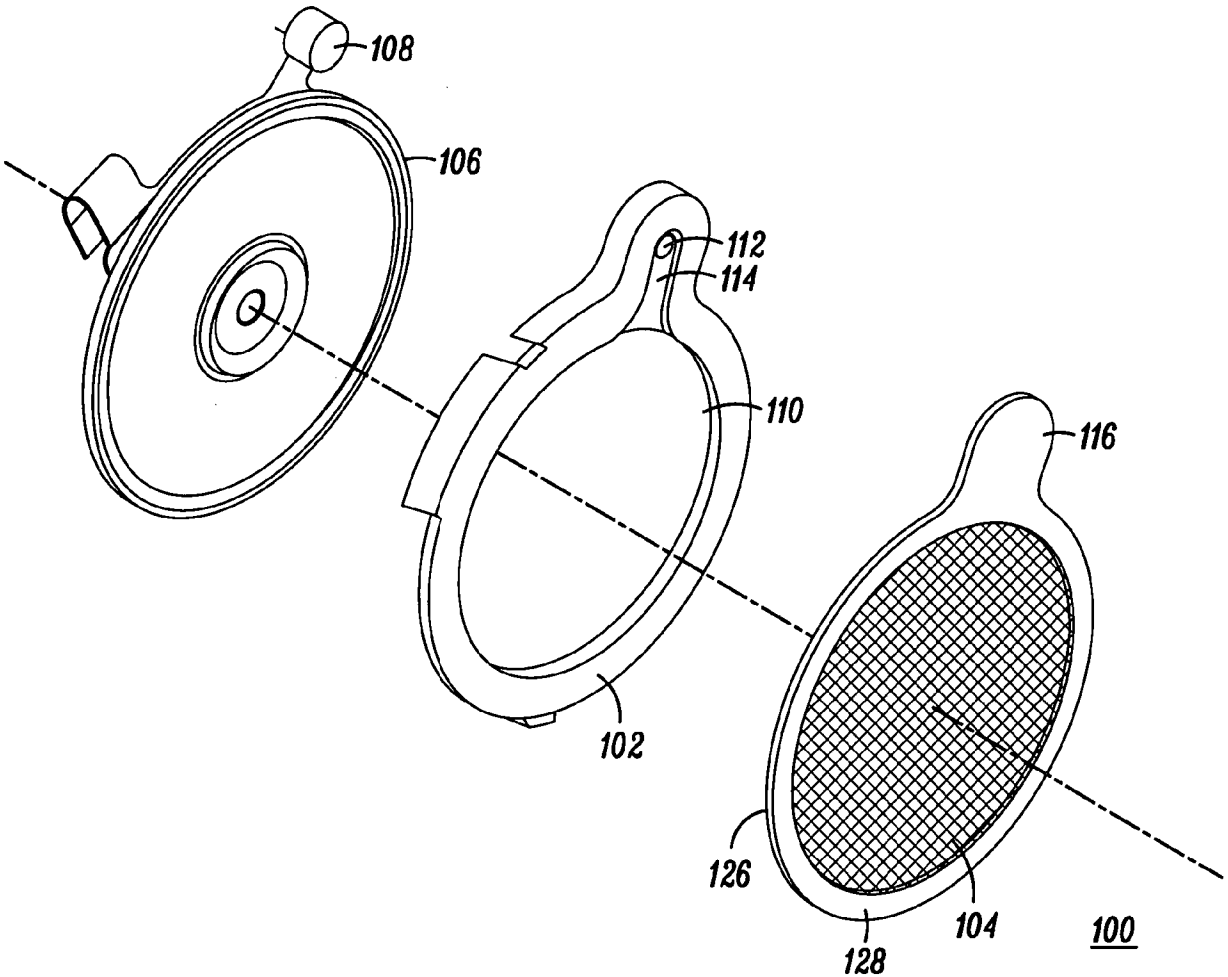
FIG. 1 is a front exploded view of an audio porting assembly in accordance with the present invention.

While the specification concludes with claims defining the features of the invention that are regarded as novel, it is believed that the invention will be better understood from a consideration of the following description in conjunction with the drawing figures, in which like reference numerals are carried forward.

The present invention may be embodied in several forms and manners. The description provided below and the drawings show exemplary embodiments of the invention. Those of skill in the art will appreciate that the invention may be embodied in other forms and manners not shown below. The invention shall have the full scope of the claims and shall not be limited by the embodiments shown below. It is further understood that the use of relational terms, if any, such as first, second, top and bottom, front and rear and the like are used solely for distinguishing one entity or action from another, without necessarily requiring or implying any such actual relationship or order between such entities or actions.

Briefly in accordance with the present invention, there is provided herein an apparatus that addresses both wind noise and water blockage problems using improved audio porting and packaging. The prior art approach of porting a microphone directly through the front surface of a radio is replaced with indirect porting in front of the radio's speaker. The speaker and microphone are covered with a membrane for water seal. The porting approach provided by the present invention combines improved microphone wind noise and water performance in a compact package.

Referring to FIG. 1, there is shown an exploded view of audio porting assembly 100 in accordance with the present invention. In accordance with the present invention, audio porting assembly 100 includes a frame 102 and a membrane 104 for coupling to the frame. The frame 102 is a unitarily molded piece part formed of flexible material, such as urethane, rubber, silicone, or the like, and includes first and second cavities 110, 112 formed therein for retaining a speaker 106 and a microphone 108 respectively. Frame 102 thus functions as a tray within which to retain the speaker 106 and microphone 108. Microphone cavity 112 provides integrated microphone boot functionality eliminating the need for a separate microphone boot piece part. If, however, it is desirable for certain designs have the frame 102 formed out of a stiff material, such as hard plastic or similar, then a microphone boot will be needed for acoustic sealing. The frame 102, formed in accordance with the present invention, provides indirect microphone porting in which the microphone 108 is ported indirectly into the speaker cavity 110. The indirect porting is provided by an opening, such as a wedge, slot, port or passage, 114 formed in the frame 102 alongside and between the speaker cavity 110 and the microphone cavity 112.

In accordance with the present invention, membrane 104 is formed so as to cover both cavities 110, 112 of frame 102. Membrane 104 is formed of a material capable of submersion and which allows the passage of audio signals. Membrane 104 includes a sealing portion 116 for sealing the membrane to the frame 102. The sealing portion 116 is preferably formed of a two-sided adhesive ring having first and second adhesive edges 126, 128.

Figure 2:
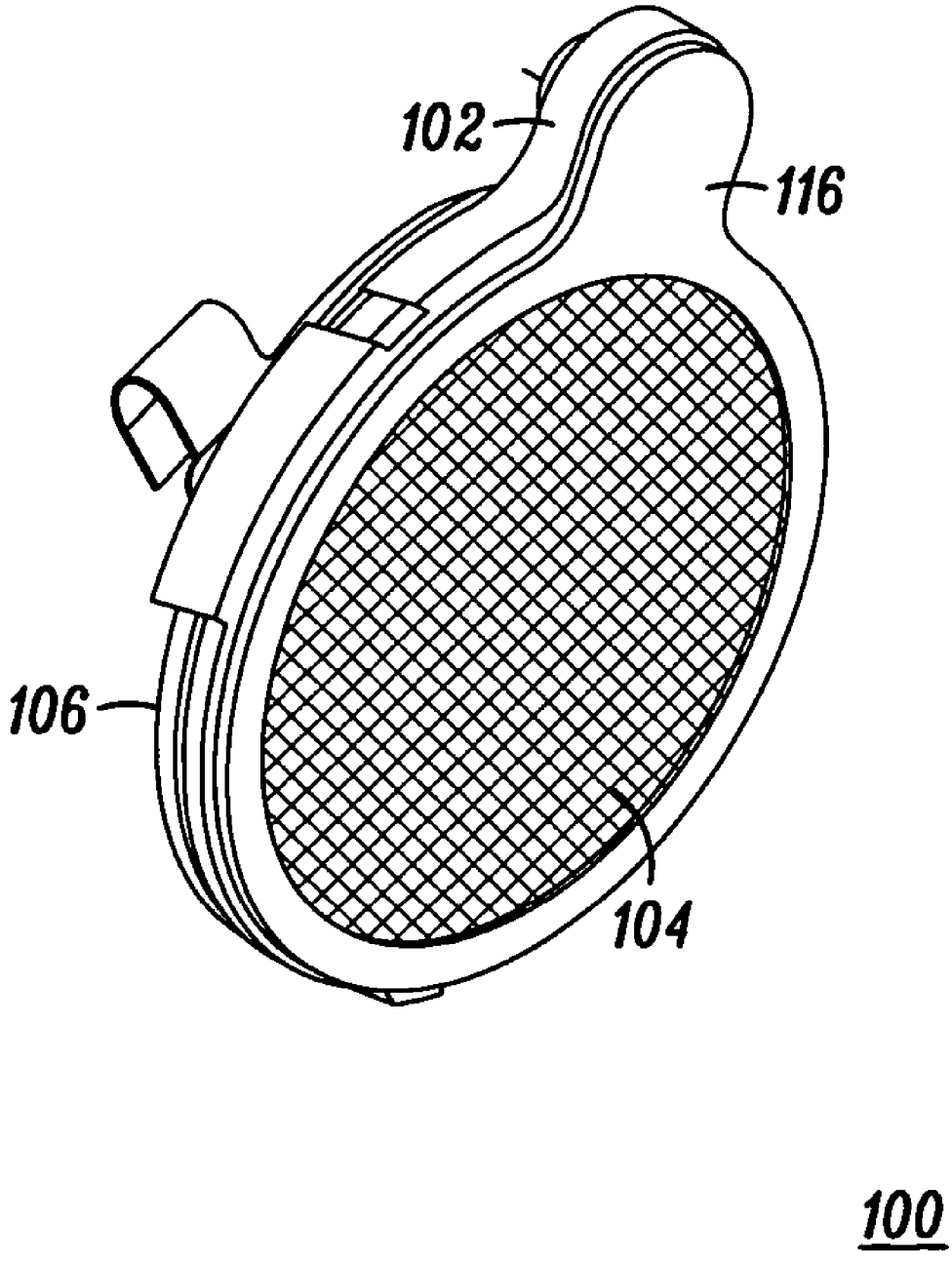
FIG. 2 is a front assembled view of the audio porting assembly in accordance with the present invention.

Referring to FIG. 2, there is shown a front assembled view of the assembly in accordance with the present invention. In accordance with the present invention, the frame 102 ports the microphone 108 from the speaker cavity 110 via opening 114 into the microphone cavity 112. The sealing portion 116 also covers the microphone cavity 112, thus eliminating any direct microphone porting. First adhesive edge 126 of membrane 104 couples the membrane to the frame 102. Second adhesive edge 128 is used to attach the assembly 100 to a housing (shown later). Membrane 104 thus provides a water tight seal for the assembly 100. As an alternative or in addition to using adhesive, the sealing portion 116 can be embodied as a compressible pad or compression o-ring integrally formed as part of the membrane 104.

Figure 3:
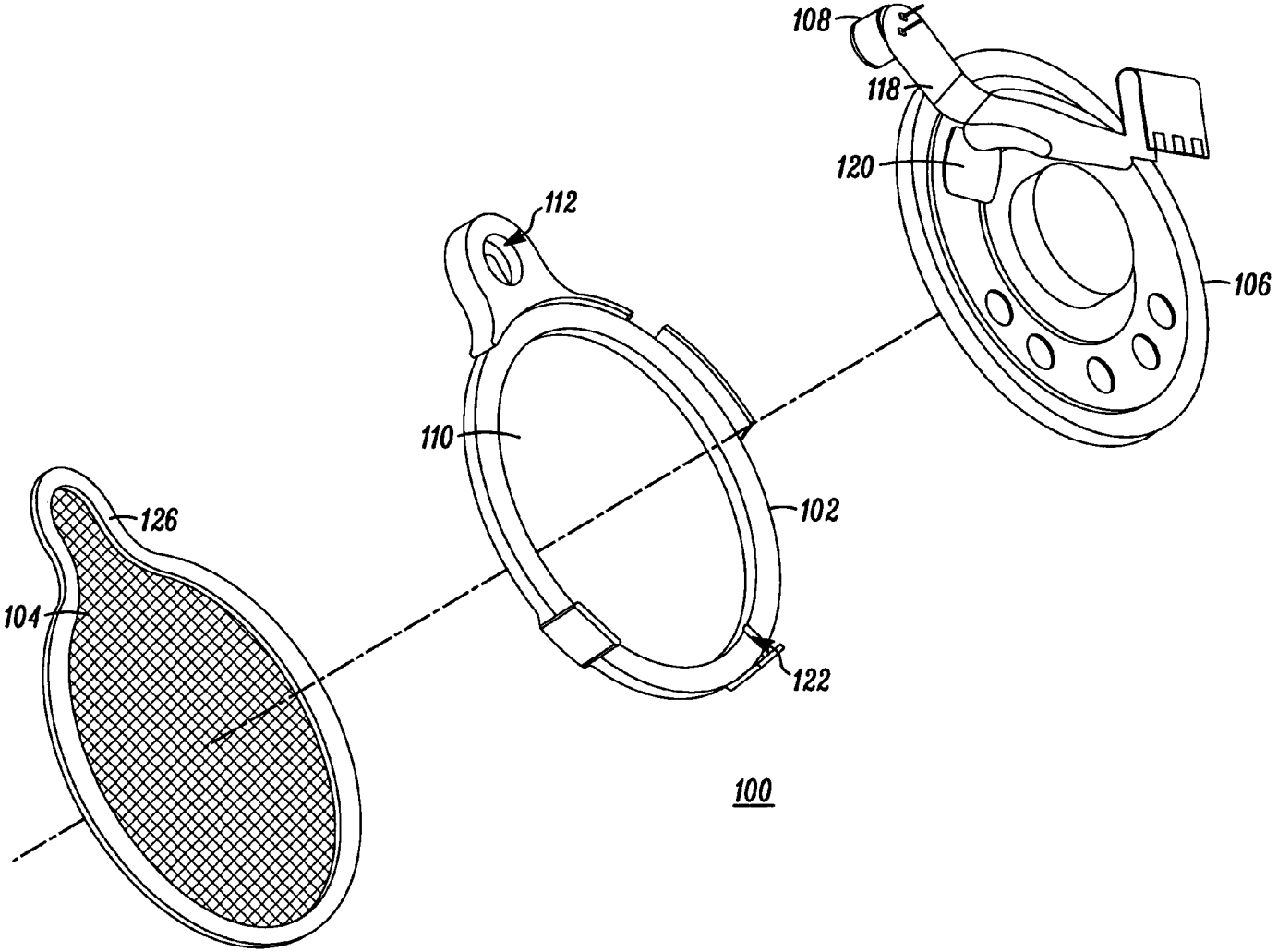
FIG. 3 is a rear exploded view of the audio porting assembly in accordance with the present invention.
Figure 4:
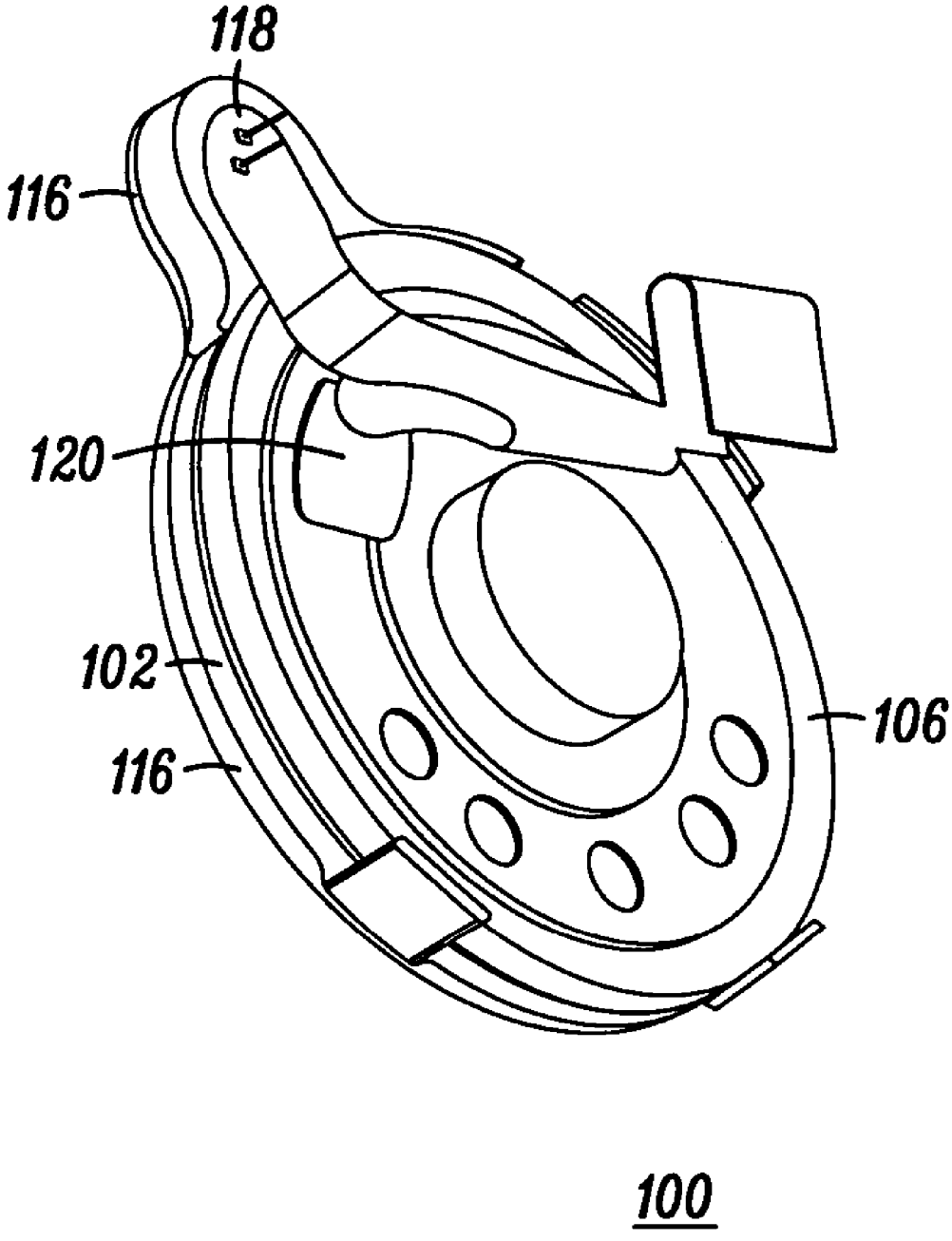
FIG. 4 is a back assembled view of the audio porting assembly in accordance with the present invention.

FIG. 3 is a rear exploded view and FIG. 4 is a back assembled view of the porting assembly 100 in accordance with the present invention. In these views, the microphone 108 is shown coupled to a flex 118 mounted to a printed circuit board (pcb) 120 on the back basket of the speaker 106. Signal leads (not shown) for the speaker 106 are also preferably coupled to the pcb 120. While this type of arrangement facilitates alignment and placement of the microphone 108 within microphone cavity 112, other arrangements, including independent separate wiring of the microphone 108 and speaker 106 can also be used. The microphone 108 is retained within microphone cavity 112 while the speaker is retained within speaker cavity 110. Membrane 104 covers the frame 102 along adhesive edge 116. Frame 102 preferably further includes a pressure relief path 122 to provide equalization of air pressure between the speaker 106 and the membrane 104.

As seen in FIGS. 2 and 4, sealing the membrane 104 to the frame 102 forms an enclosed volume of air in front of the speaker 106—with the exception of the pressure relief path 122. The porting assembly 100 formed in accordance with the present invention provides an integrated acoustic system that optimizes acoustic tuning for an improved microphone and speaker responses.

Figure 5:
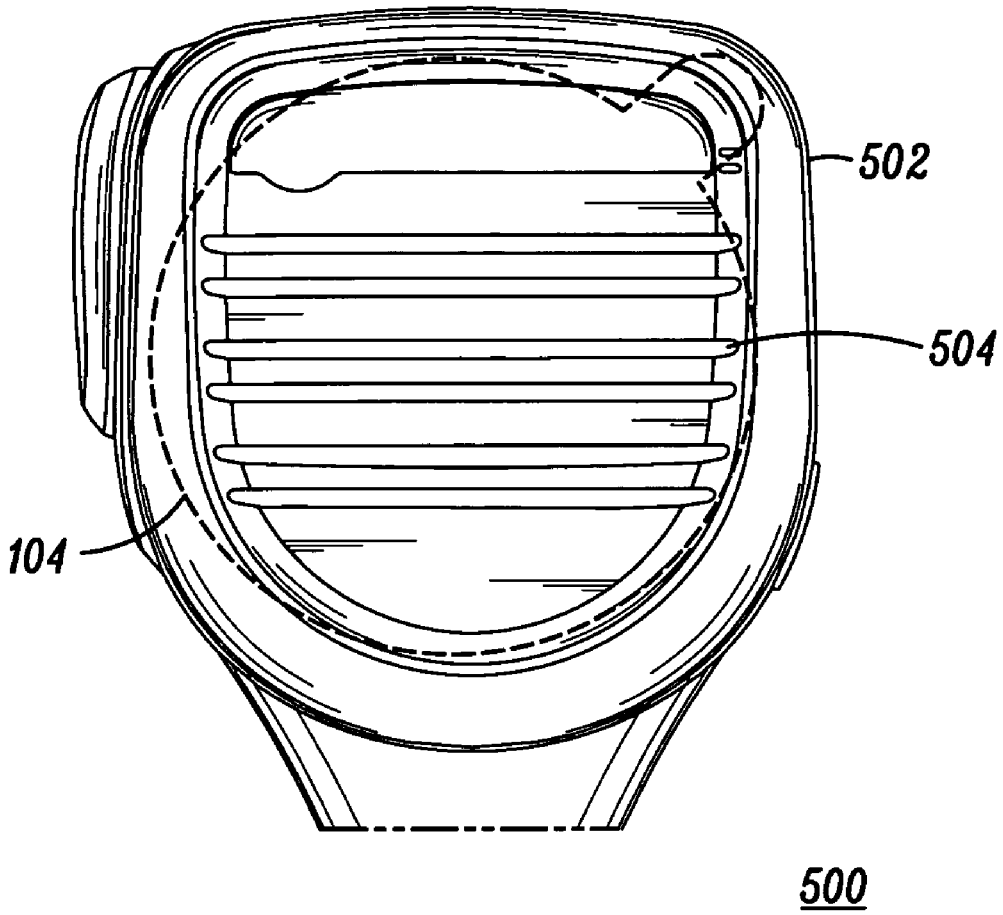
FIG. 5 is a partially assembled view of the audio porting assembly mounted within a communication device in accordance with the present invention.
Figure 6:
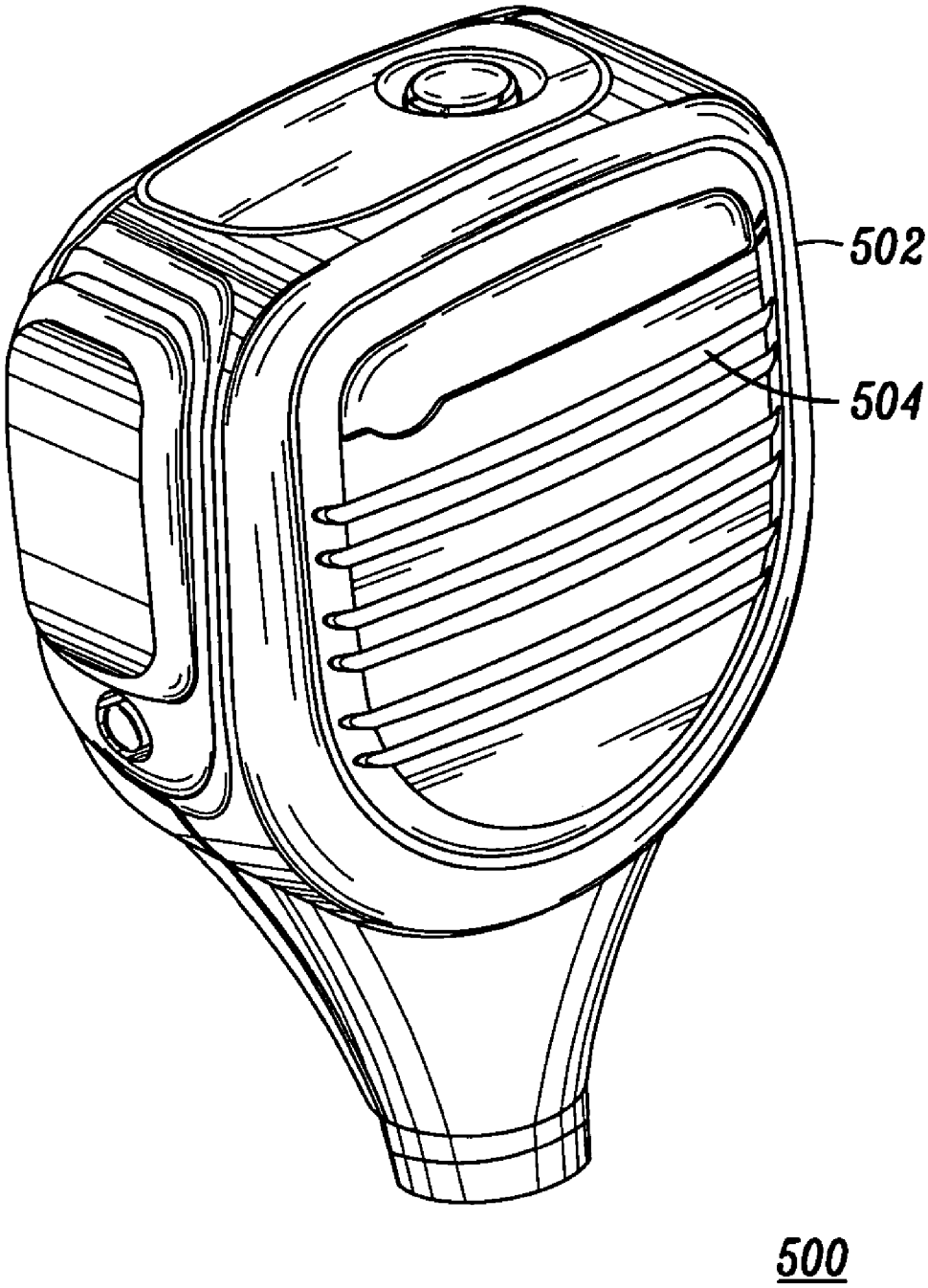
FIG. 6 is a communication device incorporating the audio porting assembly in accordance with the present invention.

FIG. 5 is a transparent view of the porting assembly formed in accordance with the present invention mounted within a communication device 500. FIG. 6 is a communication device 500 formed in accordance with the present invention, shown here as a remote speaker microphone. Referring to FIGS. 5 and 6 in conjunction with the previous figures, membrane 104 is adhesively coupled to housing 502 behind speaker grille 504. The speaker 106 is aligned behind the membrane 104 located behind the speaker grille 504 while the microphone 108 is offset from the speaker grille. The porting assembly of 100 provides an enclosed volume of air between the membrane 104 and speaker 106 and microphone 108. Audio signals are coupled to a circuit board 504 from the flex (or other interconnect means) 118. Audio coming out of the speaker 106 is directly ported through the speaker cavity 112 and speaker grille 504. In accordance with the present invention, speaker grille 504 provides an audio port for the microphone 108. Audio entering through the speaker grille 504 is indirectly ported to the microphone 108 through the opening 114 of frame 102. The speaker 106 is protected from water intrusion by membrane 104. Water is prevented from getting to the microphone 108 by a combination of membrane 104 and indirect porting of the frame 102.

The porting assembly 100 formed in accordance with the present invention provides an integrated acoustic system that optimizes acoustic tuning for improved microphone and speaker responses. The porting assembly formed in accordance with the present invention provides two Helmholtz resonances. The first is formed by the microphone cavity air volume and the port 114. The second is a result of the air volume between the grille porting 504 and the membrane 104. The length of port 114 does not affect the speaker resonance. Only the second Helmholtz resonance affects the speaker response. The second Helmholtz resonance can be tuned to optimize microphone and speaker response curves. The resonance caused by the microphone cavity 112 and port 114 only affects the microphone response, but due to the small dimensions of these passages this resonance can generally be made very high in frequency so as not to interfere with the audio band.

The Helmholtz resonance is determined from the equation:

$$f_H = \frac{1}{2\pi}\sqrt{\frac{c^2 S}{l' V}}.$$

For the second Helmholtz resonance these constants are:

c=sound speed

S=area of grille opening l'=effective length (depth) of grille slots or holes including any entrained mass V=volume of air between speaker and grille.

The resonance is inversely proportional to the square root of the air volume and also a function of both the grille porting area and length plus the membrane properties. Thus, resonance can be tuned by adjusting the membrane, air volume and grille porting dimensions.

While shown in a remote speaker microphone embodiment typically worn on the shoulder, the porting assembly 100 formed in accordance with the present invention can be incorporated into any mobile or portable communication device, including a portable radio, cell phone, mobile microphone, or the like. The utilization of a single frame having first and second cavities providing direct and indirect audio porting along with a membrane unitarily molded to form a seal over the frame provides an integrated acoustic system. Porting assembly 100 offers further advantages including a reduction in parts count, ease of assembly and improved wind noise and water intrusion performance.

Accordingly, there has been provided a porting assembly that provides improved water sealing and wind noise performance. The need for a separate microphone boot and felt piece has been eliminated thus facilitating assembly and reducing parts count. The porting assembly formed in accordance with the present invention is particularly useful in mobile and portable communication devices, such as those used in the public safety environment or wherever water and wind conditions are present.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An audio porting apparatus, comprising:

a single frame having first and second cavities with an opening formed therebetween within the frame, the first cavity having direct audio porting and the second cavity having indirect audio porting, the indirect audio porting provided from the second cavity into the first cavity through the opening in the frame; and a membrane unitarily molded to provide a seal over the frame.

2. The audio porting assembly of claim 1, wherein the membrane is adhesively coupled to the frame.

3. The audio porting assembly of claim 1, wherein the membrane is adhesively coupled to the frame.

4. The audio porting assembly of claim 1, wherein the microphone cavity provides integrated microphone boot functionality.

5. The audio porting assembly of claim 1, wherein the porting assembly provides an integrated acoustic system for tuning responses of the microphone and speaker.

6. An audio porting assembly, comprising:

a single frame having a speaker cavity and a microphone cavity formed therein;

an opening formed within the frame between the speaker cavity and the microphone cavity to provide indirect porting from the speaker cavity into the microphone cavity; and a unitarily molded membrane coupled to and providing a seal over the single frame.

7. A communication device, comprising:

a housing having a speaker grille;

an audio porting assembly coupled to the speaker grille, the audio porting assembly comprising:

a speaker;

a microphone;

a single frame having a speaker cavity and a microphone cavity formed therein, the frame providing indirect microphone porting from the speaker cavity into the microphone cavity; and a membrane covering the speaker cavity and the microphone cavity, the membrane being coupled to the speaker grille.

8. The communication device of claim 7, wherein the speaker grille provides an audio port for the microphone.

9. The communication device of claim 7, wherein the audio porting assembly is adhesively coupled between the speaker grille of the housing and the single frame.

10. The communication device of claim 7, wherein the audio porting assembly is compressibly coupled between the speaker grille of the housing and the single frame.

11. The communication device of claim 7, wherein the audio porting assembly is adhesively and compressibly coupled between the speaker grille of the housing and the single frame.

12. The communication device of claim 7, wherein the speaker is aligned behind the speaker grille and the microphone is offset from the speaker grille.

13. The communication device of claim 7, wherein the speaker grille provides an audio port for both the speaker and the microphone.

14. The communication device of claim 7, wherein audio coming out of the speaker is directly ported to the speaker grille and audio entering through the speaker grille is indirectly ported to the microphone through an opening between the speaker cavity and the microphone cavity.

15. The communication device of claim 7, wherein the microphone cavity provides integrated microphone boot functionality.

16. The communication device of claim 7, wherein the membrane minimizes water intrusion and wind noise.

17. The communication device of claim 7, further comprising a pressure relief path formed within the frame to provide equalization of air pressure between the speaker and the membrane.

18. The communication device of claim 7, further comprising:

a printed circuit board (pcb) coupled to the speaker; and a flex coupled between the microphone and the pcb.

19. The communication device of claim 7, wherein the communication device comprises a portable communication device.

20. The communication device of claim 7, wherein the communication device comprises a mobile communication device.

* * * * *